US006041778A

United States Patent [19]

Swann et al.

[11] Patent Number: 6,041,778

[45] Date of Patent: Mar. 28, 2000

[54] PERSONAL OXYGEN AND FILTERED AIR EVACUATION SYSTEM

[75] Inventors: Linsey J. Swann, Vancouver; Helmut F. Zauner, Stouffville; Ronald A. Laswick, Brampton, all of Canada

[73] Assignee: Brookdale International Systems, Inc., Vancouver, Canada

[21] Appl. No.: 09/034,026

[22] Filed: Mar. 2, 1998

[51] Int. Cl.[7] ..... A62B 7/10

[52] U.S. Cl. ..... 128/201.25; 128/205.12

[58] Field of Search ..... 128/201.25, 201.28, 128/205.25, 206.12, 201.26, 205.12, 205.28, 204.26, 202.26, 205.22

[56] References Cited

U.S. PATENT DOCUMENTS

| | | | |
|---|---|---|---|
| 5,394,867 | 3/1995 | Swann | 128/201.25 |
| 5,640,952 | 6/1997 | Swann . | |
| 5,839,436 | 11/1998 | Fangrow, Jr. et al. | 128/205.24 |

*Primary Examiner*—Aaron J. Lewis
*Assistant Examiner*—Teena Mitchell
*Attorney, Agent, or Firm*—Nixon & Vanderhye

[57] ABSTRACT

The personal emergency breathing system includes a canister carrying a layered filtration unit, a mouthpiece, a hood, a cover and a lid at opposite ends. Upon removal of the cover, the mouthpiece and hood are deployed. By placing the mouthpiece in the user's mouth and donning the hood, the user may breathe filtered ambient air. At the opposite end of the canister is a demand valve having an oxygen supply line. Upon removal of the lid at the opposite end of the canister and coupling the supply line to an oxygen bottle, oxygen may be supplied the user, augmenting the supply of ambient filtered air. Thus, the user may clip the oxygen bottle along with the canister to his/her belt and escape from toxic gases and smoke-filled environments. The demand valve supplies oxygen to the user only upon inspiratory effort and closes upon exhalation, thereby extending a given supply of oxygen up to 150% as compared to a continuous supply of oxygen.

10 Claims, 7 Drawing Sheets

PERSONAL OXYGEN AND FILTERED AIR EVACUATION SYSTEM

BACKGROUND

Emergency personal breathing systems have been proposed and offered in the past. One such system is described and illustrated in U.S. Pat. No. 5,394,867, of common assignee herewith. In the system described in that patent, a canister is provided for disposition in and deployment from an overhead compartment in an aircraft. The canister includes a filtration unit containing filtering material, a hood and a mouthpiece, including an attached nose clip, the housing being closed at one end by a cover. The canister also includes an air flow conduit bypassing the filtration unit and connected at the opposite end of the canister to an external source of air, i.e., an oxygen supply. The filtration unit in that canister includes layers of activated charcoal granules, a desiccant and a catalyst for the catalyzation of carbon monoxide to carbon dioxide, each layer being preferably separated by an electrostatically charged fabric filter for collecting particulate matter. Also, a layer of lithium peroxide or other suitable chemical may comprise a fourth layer for converting carbon dioxide to oxygen.

In that system, the canister includes a hood and a mouthpiece which are deployable from the canister upon removing the canister cover. The mouthpiece contains a one-way inhalation check valve and two one-way exhalation check valves and carries a nose clip. The mouthpiece and nose clip are enclosed within a wholly transparent flame and heat-resistant hood, preferably having a titanium coating sufficient to provide required reflection and transmission properties but sufficiently thin to afford visibility through the hood. A hood of this type is disclosed in U.S. Pat. No. 5,113,527, licensed to assignee of the present invention.

The canister of U.S. Pat. No. 5,394,867 also includes an air flow conduit which bypasses the flow of ambient air through the filtration unit and supplies air to the user of the personal emergency system from the aircraft's air supply. Thus, when the canister is deployed from the compartment in the aircraft, the aircraft air supply delivers breathable air from the external source directly to the mouthpiece, bypassing the filtration unit. The air flow inlet from the aircraft air supply has a quick connect/disconnect coupling enabling rapid disconnection of the canister from the aircraft air supply upon evacuation from the aircraft. Upon disconnection and evacuation, the individual breathes filtered ambient air. Exhalation air passes through the exhalation check valve of the mouthpiece into the hood for egress into the surrounding environment through the space between the margin of the hood and the individual's neck.

While that system is effective for use in an aircraft where it may remain connected to the aircraft's oxygen supply, it is not suitable for use in escaping from other confined spaces having resident toxic gases or smoke from a fire. For example, escape from confined spaces on ships which may contain toxic gases and/or smoke or oxygen-depleted atmospheres has been recognized as a problem for many years. Currently used devices to effect escape from the confined spaces on board a ship require an individual to move unprotected to a cache of SEED units, don the SEED units which provide a limited amount of oxygen for a very short duration, then locate and move to a cache of EEBD (emergency escape breathing device) units, exchange the SEED units for the EEBD units which generate oxygen via a chemical process, don the EEBD unit and move on to escape from the toxic gas, oxygen-deficient or smoke-filled space. This procedure is not only time-consuming but employs hazardous material. Also, those oxygen-generating systems use potassium superoxide canisters which, when mechanically actuated, cannot be stopped or controlled. A significant amount of heat is also generated by these devices once activated and have injured many users employing the system. The materials used in the EEBD system are hazardous and become unstable over time, introducing a potential source of explosion or fire, e.g., especially if the system becomes wet, on board a ship. They are also classified as HAZMAT and consequently are difficult to disperse and require controlled and costly disposal. Thus, there has developed a need for further improvements in personal breathing systems for escape from toxic gas or smoke-filled environments.

DISCLOSURE OF THE INVENTION

In accordance with the present invention, a canister similar to the canister disclosed in prior U.S. Pat. No. 5,394,867 is provided, the disclosure of U.S. Pat. No. 5,384,867 being incorporated herein by reference. However, instead of a continuous connection to a supplied air source prior to use as in the aircraft environment of that patent, the present invention provides an oxygen supply line and oxygen demand valve at an end of the canister opposite from the end containing the hood and mouthpiece for connection to an oxygen supply after the user has deployed the hood and mouthpiece and has started breathing filtered air. Because the user of the present invention typically is working in a confined space, there can be no connection with a supplied air line prior to use of the present personal breathing system. However, upon recognizing that the space has become toxic gas or smoke-filled, the user removes the canister from his/her belt, opens the cover and applies the mouthpiece to his/her mouth and the hood over his/her head. When the canister is opened, ambient air is supplied to the canister and through the filtration unit such that the user may breathe filtered ambient air. In the confined spaces such as found on ships, oxygen bottles are disposed at various locations, preferably convenient to escape routes. Thus, after the individual has donned the hood and is breathing filtered ambient air, he/she proceeds to the location of a supply of oxygen bottles. By removing the protective cap on the opposite end of the canister, the oxygen line coiled about the demand valve may be quickly coupled to the oxygen bottle and the oxygen bottle removed from its holder. The valve on the oxygen cylinder is then opened to initiate oxygen flow to the user through the canister so that the individual breathes both filtered ambient air and oxygen from the bottle.

It is, however, an important feature of the present invention that the supplemental supply of oxygen is supplied only on demand. Thus, the on-demand oxygen supply valve carried by the canister opens to supply oxygen to the user, only upon inspiratory effort by the user, thereby supplementing the air supplied the user through the filtration unit. Upon exhalation, the oxygen demand valve closes, preventing the oxygen from reaching the user. It will be appreciated that existing emergency escape systems supply oxygen once activated on a constant flow basis. Consequently, about 50% of the oxygen is wasted during expiration phases of the breathing cycle. The present oxygen demand valve, however, bleeds $O_2$ from the oxygen bottle at a preset low pressure and on demand only. Thus, the period of oxygen delivery can be increased by up to 150% or the associated oxygen bottle can be decreased in size and cost for the same period of delivery as existing equipment.

In a preferred embodiment according to the present invention, there is provided a personal emergency breathing system for filtering ambient air and flowing oxygen from an external source other than ambient air, comprising a canister having a body with an opening and a cover normally closing the opening, an air filtration unit disposed within the body of the canister for filtering ambient and having an air inlet for receiving ambient air and an air outlet, the ambient air being receivable through the air inlet into the filtration unit where it is filtered and passed through the air outlet, a mouthpiece coupled to the canister for receiving filtered air from the outlet of the filtration unit, a hood coupled to the canister and enveloping the mouthpiece, the mouthpiece and the hood being disposed in a collapsed condition in the canister adjacent the opening and between the cover and the filtration unit whereby, upon opening of the cover, the hood and the mouthpiece are deployable from the canister through the opening to a location external to the canister, enabling flow of filtered air from the outlet to the mouthpiece, the hood having an opening for receiving an individual's head and neck whereby the hood, when deployed, may envelope an individual's head and an oxygen flow conduit carried by the canister body bypassing the filtration unit and having an oxygen flow inlet for connection with an external source of breathable oxygen other than ambient air and an air flow outlet, the air flow outlet lying in communication with the mouthpiece whereby the air flow conduit enables flow of oxygen from the external source of breathable air into the mouthpiece when the hood and the mouthpiece are deployed, this flow conduit including a demand valve enabling flow of oxygen upon inspiration by the individual and preventing flow of oxygen from the external source upon expiration by the individual.

Accordingly, it is a primary object of the present invention to provide a novel and improved personal emergency breathing system for supplying combined filtered ambient air and oxygen from a supplied external air source with the oxygen being supplied only upon demand.

BEST MODE FOR CARRYING OUT THE INVENTION

Figure 1:
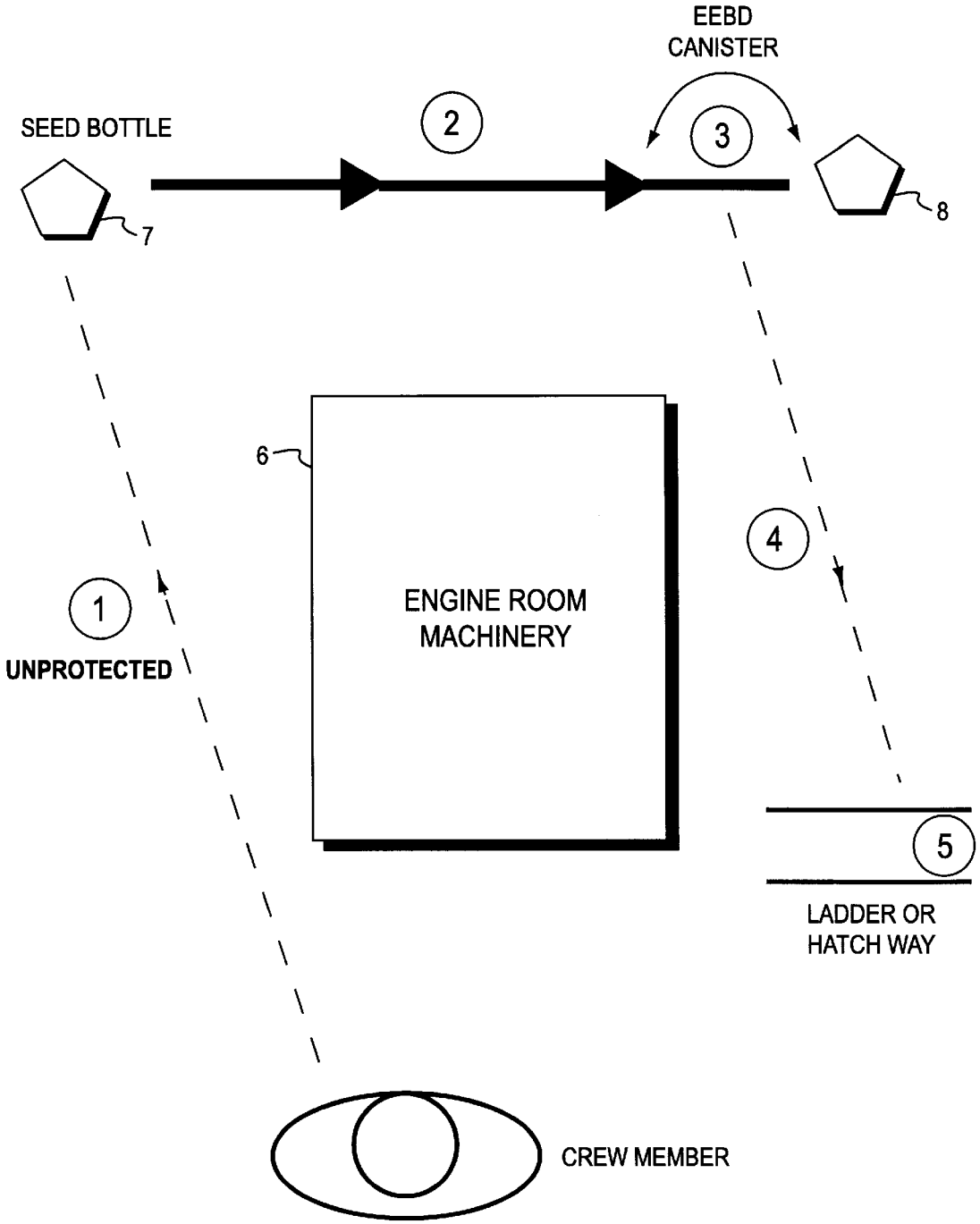
FIG. 1 is a schematic representation of a prior system for emergency escape from toxic gas or smoke-filled spaces.

Turning now to the drawings, particularly to FIG. 1, there is illustrated, for example, a confined toxic gas or smoke-filled space 6 such as the engine room of a ship and an individual designated crew member in that confined space. As explained above, that individual, when confronted with toxic gas or smoke-filled space has typically been required to move, e.g., upon path 1, to a location containing a SEED unit 7 where the individual dons the SEED unit. The individual then moves on, e.g., along path 2, to another location 3 containing emergency escape breathing devices or EEBD units 8, where the SEED unit 7 is exchanged is for an EEBD unit 8, the latter generating oxygen, whereas the former does not. The EEBD unit 8 is then donned and the user moves, e.g., along path 4, to escape from the toxic gas or smoke-filled environment to an escape ladder or hatch 5 for egress.

Figure 2:
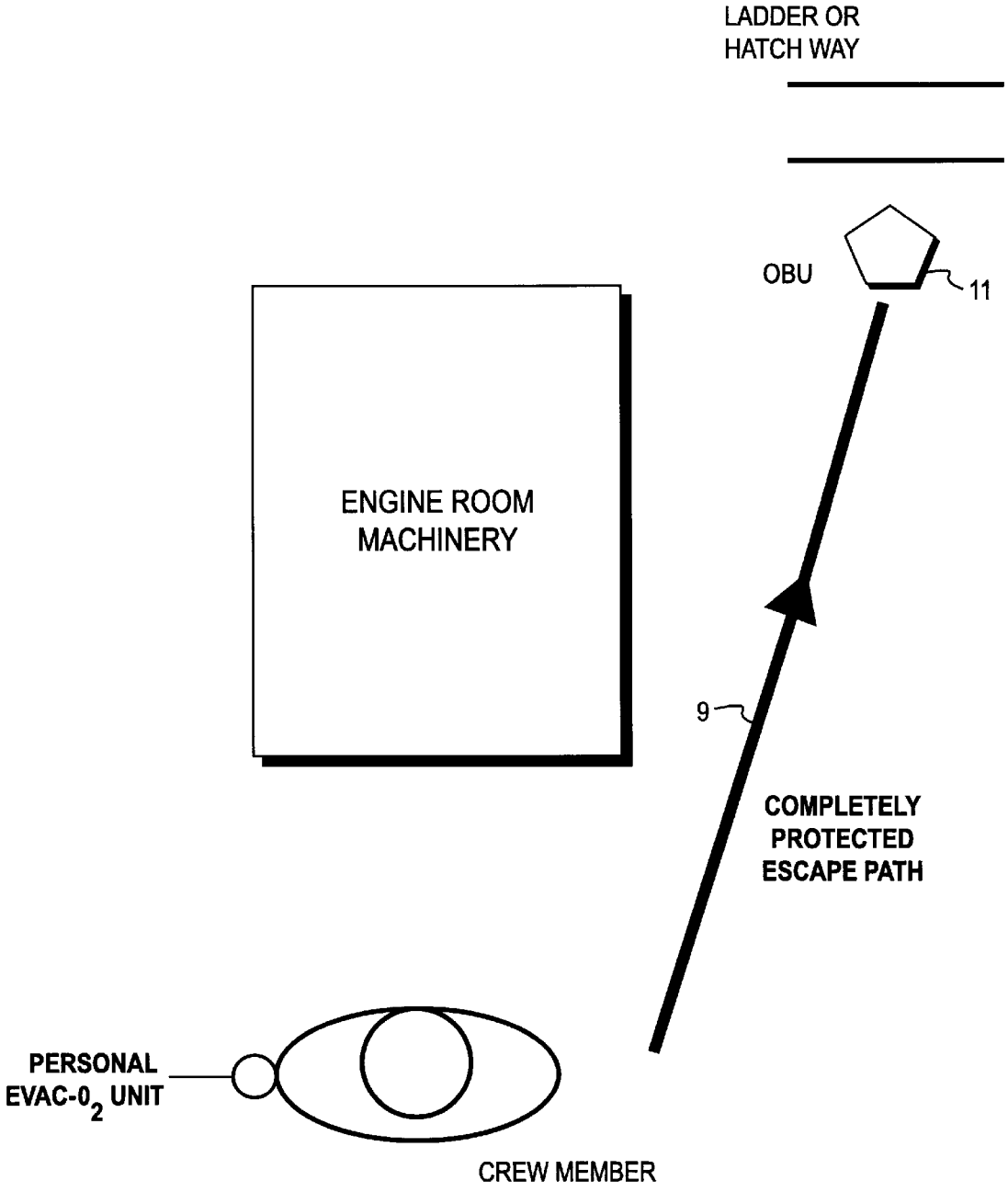
FIG. 2 is a schematic illustration of a method of escape from toxic gas or smoke-filled environments employing the system of the present invention.

Referring to FIG. 2, by using the system of the present invention, the individual, i.e., crew member, may escape the toxic gas or smoke-filled environment by employing the personal disposable emergency breathing system of the present invention to breathe filtered ambient air as detailed hereinafter. While breathing filtered ambient air, the individual may then move directly to a cache of oxygen bottles 11, preferably disposed near or on a designated escape route. Note that the path 9 used by the individual from the moment that the canister of the present invention is employed to the external source of oxygen, i.e., the oxygen bottles, is a completely protected escape path in that the individual is able to breathe filtered ambient air immediately upon deploying the hood and mouthpiece from the canister. In contrast, and referring back to FIG. 1, the individual, once recognizing he is in the toxic gas or smoke-filled environment, must move along an unprotected path 1 to the SEED bottle 7. At the oxygen bottle cache, the individual removes the oxygen bottle from its mount, attaches the oxygen supply line of the canister to the bottle and opens the valve on the oxygen bottle. In this manner, the user is able to breathe a combination of filtered ambient air as well as oxygen from the external source, i.e., the oxygen bottle. Thus, in the event of oxygen depletion in the space, the user has available the oxygen supplied from the external source. As will become clear from the ensuing description, the individual is provided oxygen only on demand, i.e., only on inspiratory effort, the oxygen supply being terminated upon exhalation. Thus, the oxygen supply may be one-half of a normal continuous supply of oxygen usable over the same period of time. Alternatively, additional time, i.e., up to 150%, may be afforded an individual to escape the space by supplying the same quantity of oxygen as in prior continuous oxygen flow escape systems.

Figure 3:
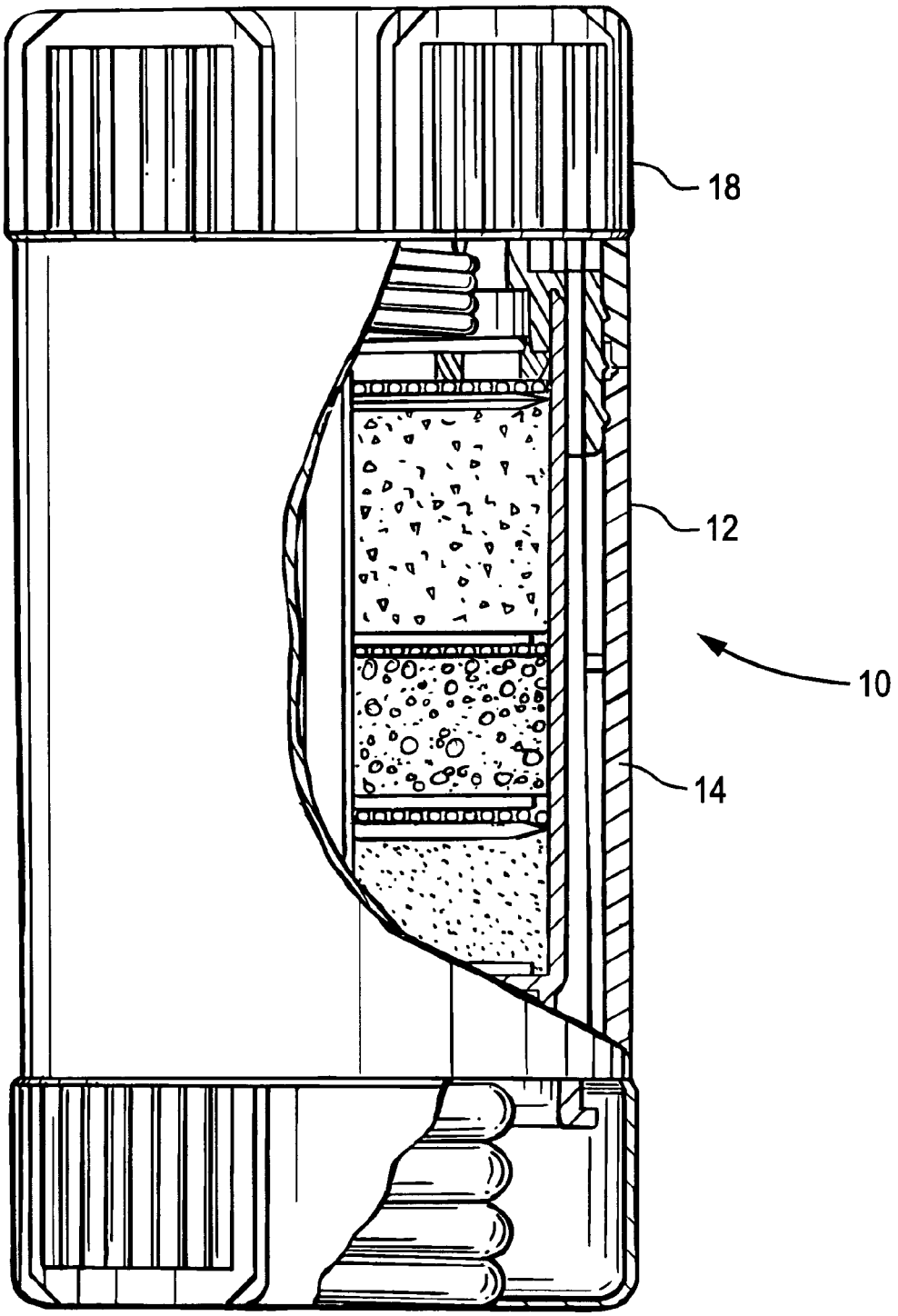
FIG. 3 is a side elevational view of the canister forming part of the present system with parts broken out and in cross-section.
Figure 4:
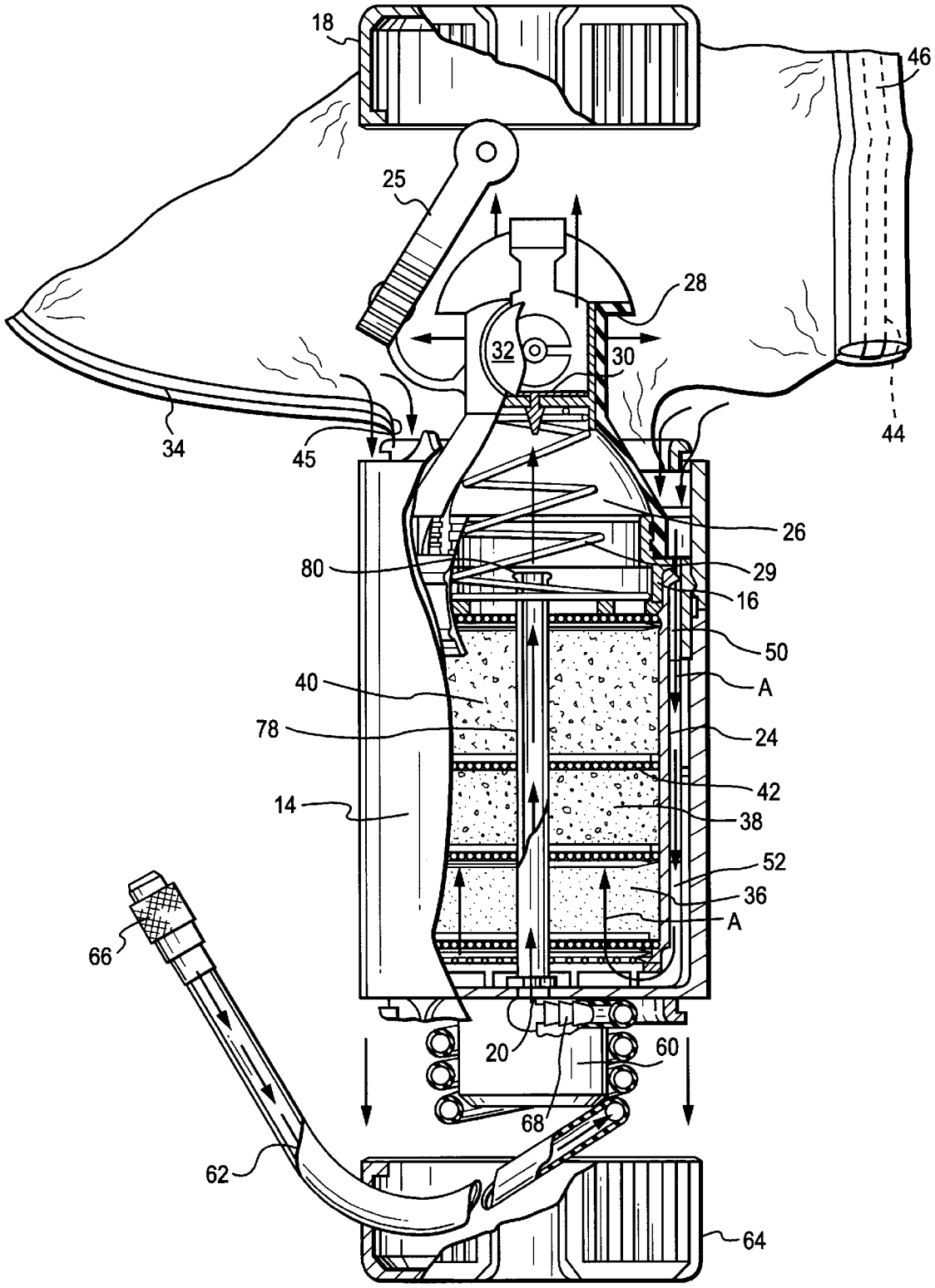
FIG. 4 is a fragmentary exploded view of the canister in a deployed condition and with parts broken out and in cross-section for ease of illustration.

Referring now to FIGS. 3 and 4, there is illustrated a personal disposable emergency breathing system according to the present invention, generally designated 10. The system is illustrated in a non-use condition, preferably attachable to the belt of an individual such that the individual may carry the canister with him at all times when in confined spaces where there is a possibility of toxic gases, oxygen deficiency or smoke. System 10 includes a canister 12 having a body 14 with an intermediate securing ring 16 and a cover 18. Canister 12 is preferably formed of a color-impregnated flame-retardant plastic material such as ABS. Canister body 14 is closed at its lower end except for an aperture 20 (FIG. 4) which serves as an air inlet for the emergency breathing system as described hereafter.

The canister 12 also carries a filtration section 24, a mouthpiece 28 with a nose clip 25 and a plenum 26 for conveying inhalation gas from the filtration section 24, and from the external air supply source when coupled to the canister, to the mouthpiece 28. The mouthpiece includes an inhalation check valve 30 and a pair of exhalation check valves 32, respectively, for preventing reverse outflow of air from the mouthpiece during exhalation and enabling outflow of gases during exhalation into the hood as described hereafter. A transparent hood 34 is also provided, preferably formed of multi-layers, e.g., a fluoroethylene polymer, a layer of Kapton film and an outer layer of sputtered titanium, as set forth in U.S. Pat. No. 5,113,527, the disclosure of which is incorporated herein by reference. The mouthpiece, nose clip, plenum and hood are disposed within the canister 12 when the open end of the canister is closed by the cover 18, whereby the elements are substantially sealed from the atmosphere. The hood 34 and mouthpiece 28 are folded into the securing ring 16. When the cover 18 is removed, the plenum 26, mouthpiece 28 and hood 34 are automatically deployed from the canister 12 typically by the bias of a spring 29, the plenum, mouthpiece and hood remaining connected to the canister 12.

The filtration section 24 comprises layers of air-filtering material. The filtering materials are preferably arranged in stages, the first stage 36 comprising activated carbon granules for removing polar organic gases, e.g., benzene, cyanides and the like, as found in dense smoke of a typical fire, an intermediate filtration stage 38 comprised of a desiccant to remove moisture from the inhaled air, e.g., a zeolite type 13× and a final filtration stage 40 formed of a material which converts carbon monoxide to carbon dioxide by a catalyzation process, for example, a carulite-type 200, a copper manganese oxide hopkalite catalyst. A fourth stage may be optional, containing lithium peroxide or other suitable chemicals for converting carbon dioxide to oxygen. Electrostatically charged fiber filters 42 may be spaced from one another. The filters 42 are capable of collecting and absorbing particulate matter and help prevent migration of dust.

The hood 34 is preferably formed of a clear, heat-resistant multi-layered material as previously described and which material does not impede the passage of sound and thus allows two-way communication. Hood 34 has a first full-width opening 44 sufficient to pass over an individual's head whereby hood 34 may completely envelope the user's head. The opening 44 is provided with an elastic fabric or draw-type tie band 46, preferably colored, which after the hood 34 is drawn over the individual's head, forms a substantial seal with the individual's neck. A second opening 45 in the hood is sealed to the canister during manufacture. The hood is also preferably coated with titanium as set forth in U.S. Pat. No. 5,113,527, as previously noted.

The upper end of the canister 12 has equally spaced tabs or partial threads for securing the cover 18 to the canister with an O-ring seal therebetween. The securing ring 16 has external threads for mating with threads on the internal wall surfaces of the canister body. The ring 16 includes circumferentially spaced apertures 50 affording communication between the upper end of the canister when the cover 18 is removed and an annular passage 52 between the filtration unit and the interior wall of the canister. The filtration unit 24 has a plurality of openings at its lower end whereby, when the cover is removed, air may flow into the canister body through the openings 50 and through the annular passage 52 and openings in the bottom of the filtration unit for flow upwardly through the filtering material of the filtration unit. The air flow passage is illustrated by the arrows A along the outer margins of the canister and through the filtration section.

Figure 5:
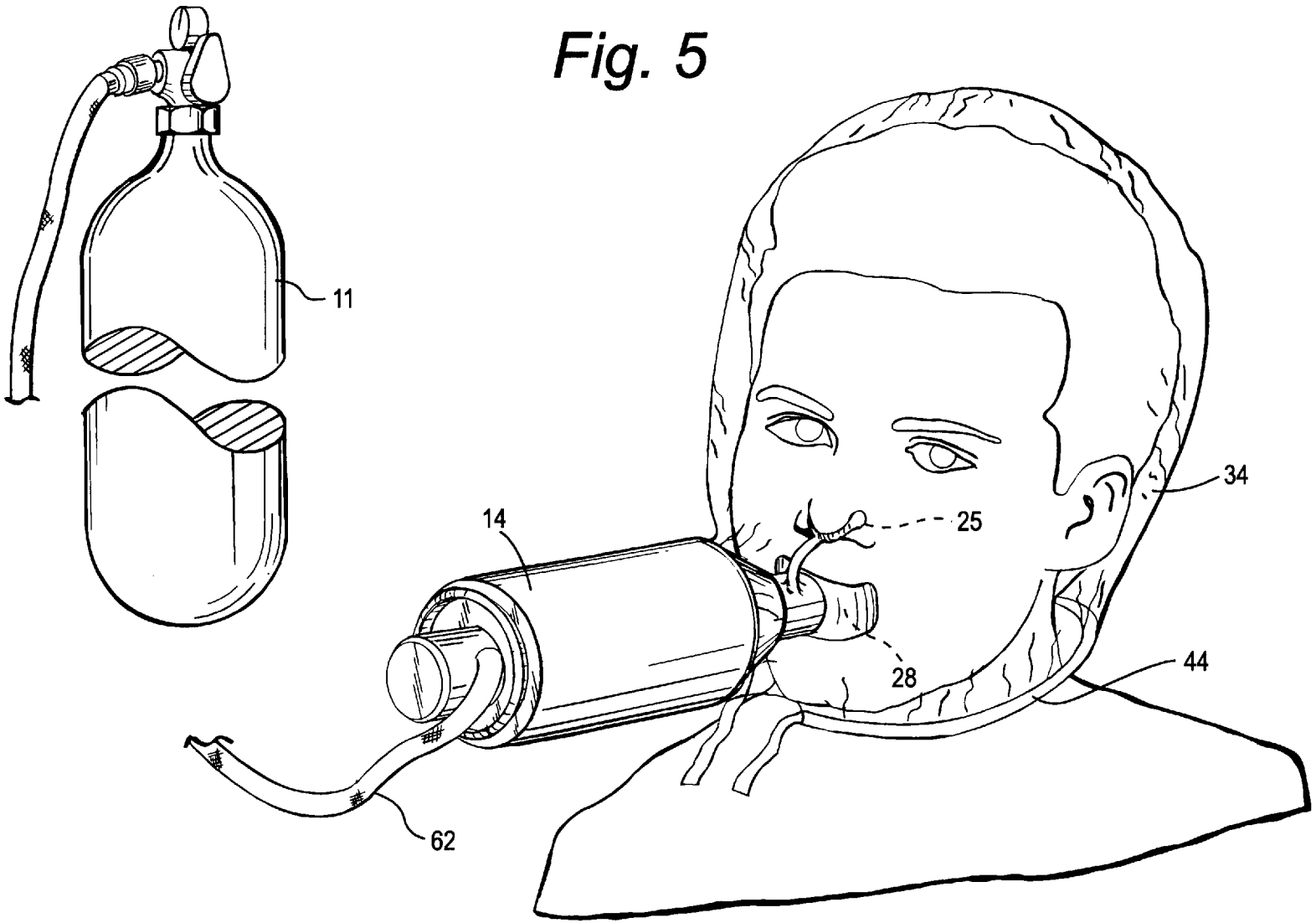
FIG. 5 is a schematic illustration of the canister employed by an individual in accordance with the system of the present invention.

In accordance with the present invention, there is also provided an oxygen demand valve 60 secured to the lower end of the canister 12. An oxygen supply line 62 is wound about the reduced diameter demand valve 60 for retention on the canister and within a lid 64 secured, for example, by threading onto the end of the canister opposite cover 18. The end of the oxygen supply line 62 is provided with a quick connect/disconnect coupling 66 for coupling to an oxygen bottle, e.g., bottle 11 (FIG. 5). It will be appreciated that the oxygen supply line, including the coupling 66, is enveloped within the lid 64 when secured to the canister. The proximal end of the oxygen supply line 62 is coupled to a fitting 68 in communication with a jet orifice 70 forming part of the demand valve 60.

Figure 6:
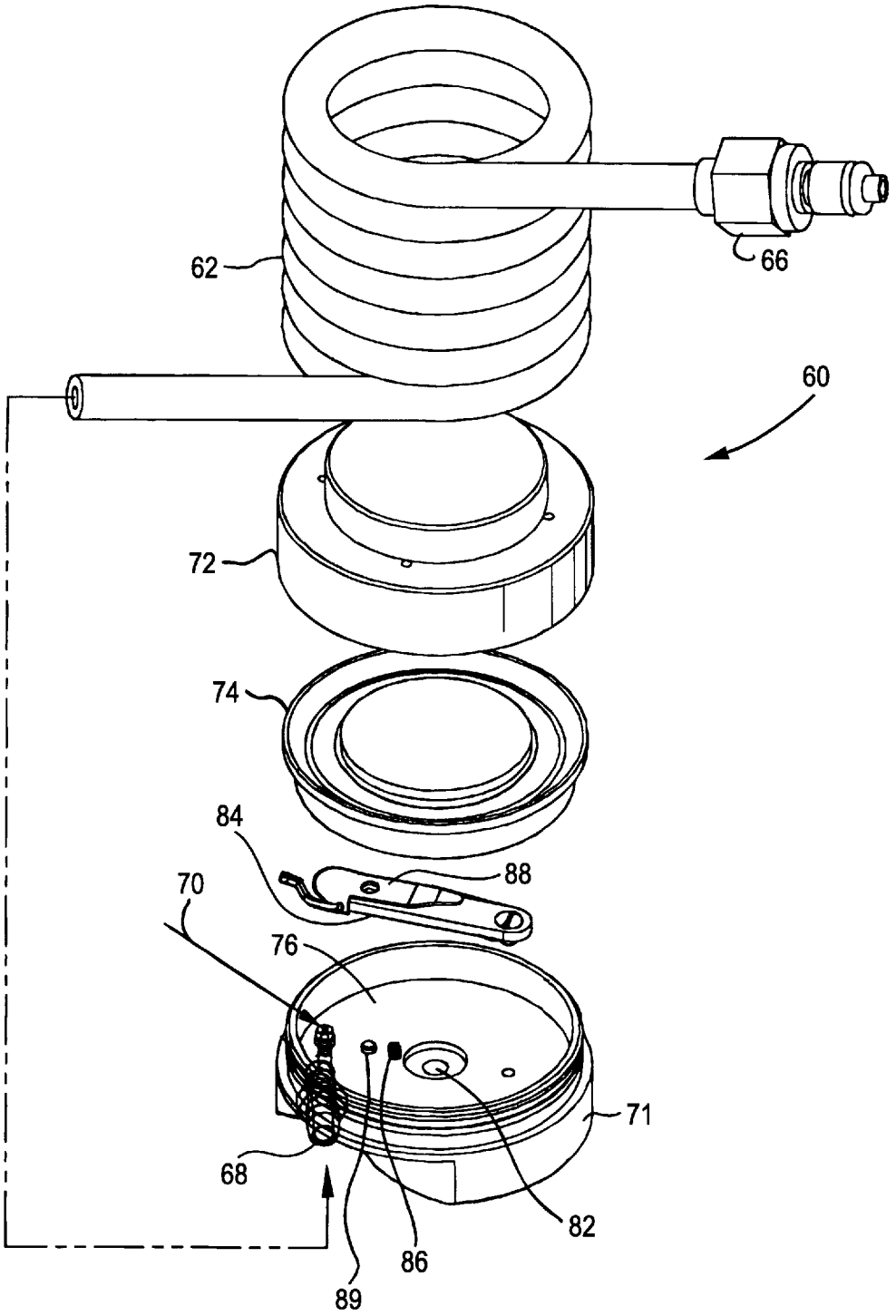
FIG. 6 is an exploded view of the oxygen demand valve carried by the canister of the present invention.

Referring to FIG. 6, which illustrates the demand valve in an exploded perspective view and inverted from the illustration of FIG. 4, there is provided demand valve housing parts 71 and 72 including a diaphragm 74 in part defining a chamber 76 between parts 71 and 72. The chamber 76 lies in communication with a central air supply tube 78 (FIG. 4) extending centrally through the filtration unit, terminating in an air outlet 80 in the plenum 26. The outlet from the chamber 76 is illustrated at 82 and lies in communication with aperture 20 (FIG. 4). Within chamber 76, there is provided a tilt lever 84 having one end which overlies the jet orifice 70 whereby the lever closes the orifice 70, preventing inflow of oxygen. The lever is maintained in the closed position by a balancing spring 86 mounted on the demand valve housing part 71. The diaphragm 74 is in contact with an arm 88 of the lever 84. When coupling 66 is connected to an oxygen supply bottle, oxygen at a pressure of about 20 psi is supplied to the inlet 68 of the demand valve via the supply line 62. The supply line 62 has a CPC quick disconnect system for attachment to the gas regulating source which is attached to the high pressure oxygen bottle, e.g., 1000–2000 psi. The gas flows from the inlet 68 to the jet orifice 70 which has an outlet calibrated to provide a predetermined rate of flow, for example, 5 liters per minute. The jet orifice 70 is maintained in a closed condition by the tilt lever 84 held in the closed position by the balancing spring 86. Diaphragm 74 contacts the arm 88 of the lever 84. The height of arm 88 is adjustable by a screw 89 which applies pressure to the base of the lever 84. The opening 82 enables negative pressure to be applied to the chamber 76 by the inspiratory effort of the user. When negative pressure is applied to the diaphragm 74, the diaphragm acts upon the lever 84 to move the lever on its pivot in a direction away from the jet orifice 70, enabling flow of oxygen to pass through the inlet and into the central passage 78 to supply oxygen to the user. When the negative pressure generated by the inspiratory effort of the user ceases, the diaphragm 74 moves back to its normal resting position by the elasticity of the diaphragm and the spring tension on the tilt lever 84 acting on the underside of the diaphragm 74 closes the jet orifice 70. The opening cycle commences with the next inspiratory effort of the user.

Figure 7:
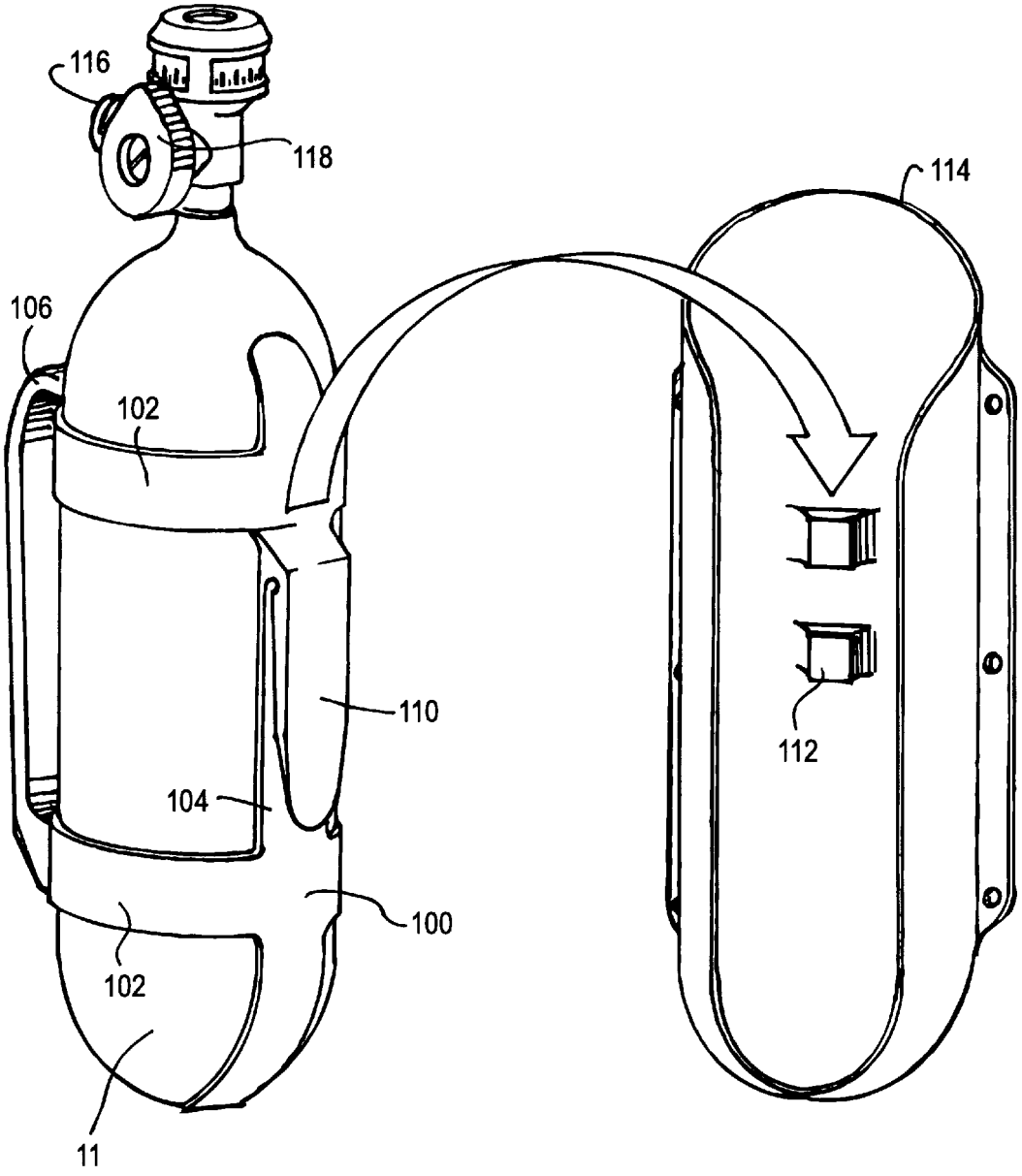
FIG. 7 is a schematic illustration of an oxygen bottle and a mount and a cradle therefor.

Referring to FIG. 7, there is illustrated one of several oxygen bottles 11 located adjacent an escape ladder or hatchway as illustrated in FIG. 2. Each bottle 11 includes a cradle 100 comprised of a pair of vertically spaced horizontal bands 102 and a pair of circumferentially spaced vertical bands 104 encompassing the bottle 11. One of the vertical bands 104 carries a grab handle 106. The other vertical band 104 carries an outwardly and downwardly projecting clip 110 for engaging in a pair of retaining slots 112 spaced vertically from one another along a wall or bulkhead mount 114. Thus, the bottle 11 may be removed from the wall mount 114 by grasping handle 106 and lifting the bottle 11 so that clip 110 clears the slots 112. The clip 110 may then be used to support the bottle from the user's belt or trousers.

Referring back to FIG. 4, when confronted with a toxic gas or smoke-filled environment, a user carrying the canister on his/her belt may remove the canister from its carried position and open the cover 18 whereupon the hood and mouthpiece are deployed from the canister under the bias of spring 29. By placing the mouthpiece in the mouth, donning the hood, and pulling the drawstring 46 about the neck, the user is able to breathe filtered ambient air which enters the canister by way of openings 50 and passage 52 and into the plenum 26 for delivery to the user's mouth. The valve 30 opens upon inhalation and valves 32 remains closed during inhalation. During exhalation, valve 30 closes and valve 32 opens to supply exhaled air to the interior of the hood, where it passes out of the hood through the neck opening 44, the opening 44 providing a comfortable but purposefully not complete seal. The individual is therefore protected from the toxic gas or smoke-filled environment for a limited period of time by breathing filtered air. Thus, the individual is completely protected en route, i.e., along path 9 as illustrated in FIG. 2, to the external supply of oxygen, i.e., the oxygen bottles, which typically would be stored near an exit hatch or ladder. When the individual arrives at the oxygen bottle supply, the lid 64 is removed from the canister and the quick connect coupling 66 is secured to the oxygen bottle quick connect 116 (FIG. 7). The on/off knob 118 is then turned to supply oxygen to the supply line 62. The individual may then remove the bottle 11 from mount 114 and clip it to his belt. During inhalation, the demand valve 66 permits ingress of oxygen through the demand valve into the central passage 78 for combination with the filtered ambient air flowing through the filtration unit. Upon exhalation, the negative pressure in the chamber 76 generated by the inspiratory effort ceases and the bias of the diaphragm pivots the lever 84 to close the jet orifice, thereby preventing oxygen from being supplied to the user during exhalation. On the next cycle of inhalation, the negative pressure in the chamber 76 causes the diaphragm to act upon the lever 84, pivoting it against the bias of spring 86 to open the jet orifice, enabling flow of oxygen to pass through supply line 62 into passage 78 to the user. Thus, the user breathes filtered air combined with oxygen from the bottle 11 simultaneously as he/she moves along path 9 (FIG. 2) to the exit, e.g., an escape ladder or hatchway.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A personal emergency breathing system for filtering ambient air and flowing breathable oxygen from an external source other than ambient air, comprising:

a canister having a body with an opening and a cover normally closing said opening;

an air filtration unit disposed within the body of said canister for filtering ambient air and having an air inlet for receiving ambient air and an air outlet, the ambient air being receivable through said air inlet into said filtration unit where it is filtered and passed through said air outlet;

a mouthpiece coupled to said canister for receiving filtered air from the outlet of said filtration unit;

a hood coupled to said canister and enveloping said mouthpiece, said mouthpiece and said hood being disposed in a collapsed condition in said canister adjacent said opening and between said cover and said filtration unit whereby, upon opening of said cover, said hood and said mouthpiece are deployable from said canister through said opening to a location external to said canister, enabling flow of filtered air from said outlet to said mouthpiece, said hood having an opening for receiving an individual's head and neck whereby the hood, when deployed, may envelope an individual's head; and an oxygen flow conduit carried by said canister body bypassing said filtration unit and having an oxygen flow inlet for connection with an external source of breathable oxygen other than ambient air and an oxygen flow outlet, said oxygen flow outlet lying in communication with said mouthpiece whereby said oxygen flow conduit enables flow of oxygen from the external source of breathable oxygen into said mouthpiece when said hood and said mouthpiece are deployed, said oxygen flow conduit including a demand valve enabling flow of oxygen upon inspiration by the individual and preventing flow of oxygen from the external source upon expiration by the individual.

2. A system according to claim 1 wherein said demand valve opens in response to an inspiration pressure of no less than about 2.5 cm/$H_2O$.

3. A system according to claim 1 wherein said canister body is elongated and has an opening at one end thereof, said filtration unit being centrally disposed in said canister body, said oxygen flow conduit comprising a passage extending through said filtration unit, said oxygen flow inlet being carried by said canister body adjacent an end of said body opposite said one end for connection to the external source of breathable oxygen.

4. A system according to claim 1 wherein said demand valve includes a chamber defined in part by a diaphragm and having an inspiratory inlet and an orifice coupled to said external source of oxygen for supplying oxygen to said chamber, a member in said chamber movable between a first position closing said orifice and a second position opening said orifice in response to inspiratory effort by the individual.

5. A system according to claim 4 wherein said member includes a pivoted lever and a spring for biasing the lever into the first closed position.

6. A system according to claim 1 in combination with the external source of breathable oxygen, said external source comprising a portable oxygen container having a first quick connect, said oxygen flow conduit having a second quick connect whereby said conduit is readily and quickly connected to said oxygen container.

7. A system according to claim 6 including a cradle for carrying said container, said cradle having a handle whereby a user may grasp the cradle handle to carry the oxygen container.

8. A system according to claim 7 including a mount for the oxygen container and cradle, said mount having retainers and said cradle having a clip whereby said retainers and clips cooperate to releasably mount the oxygen container to said mount.

9. A system according to claim 1 wherein said canister is generally cylindrical and said cover lies at one end of said canister normally closing said opening, said demand valve being mounted on an end of said cylindrical canister opposite said one end and having a reduced lateral dimension, said flexible conduit being disposed about said demand valve and a lid removably connected to said canister at said opposite end thereof and enveloping said flexible conduit and said demand valve enabling, upon removal of said lid from said canister, connection of said oxygen flow inlet with the external source of breathable oxygen.

10. A system according to claim 9 wherein said demand valve has a reduced diameter relative to the diameter of said canister, said flexible conduit being coiled about said demand valve and within said lid prior to removal thereof.

* * * * *